United States Patent [19]

Onodera

[11] Patent Number: 4,464,860

[45] Date of Patent: Aug. 14, 1984

[54] LAUNCHING APPARATUS FOR RESILIENT DRIVE MOBILE TOY

[75] Inventor: Takehiko Onodera, Noda, Japan

[73] Assignees: Kabushiki Kaisha Bandai; Sanimu Co., Ltd., both of Japan

[21] Appl. No.: 414,399

[22] Filed: Sep. 2, 1982

[30] Foreign Application Priority Data

Feb. 2, 1982 [JP] Japan ..... 57-13278[U]

[51] Int. Cl.[3] ..... A63H 33/00

[52] U.S. Cl. ..... 446/491; 238/10 R; 446/430; 446/435

[58] Field of Search ..... 46/1 K, 202, 206, 208, 46/209, 201, 204

[56] References Cited

U.S. PATENT DOCUMENTS

| | | | |
|---|---|---|---|
| 2,731,765 | 1/1956 | Carver | 46/209 |
| 3,782,032 | 1/1974 | Glass et al. | 46/202 |
| 4,087,935 | 5/1978 | Edmisson et al. | 46/202 |
| 4,192,093 | 3/1980 | Hamano | 46/204 |
| 4,203,247 | 5/1980 | Moe et al. | 46/202 |

*Primary Examiner*—Mickey Yu

*Attorney, Agent, or Firm*—R. Gale Rhodes, Jr.

[57] ABSTRACT

A launching apparatus for a resilient drive mobile toy having a driven wheel. The launching apparatus includes a receptacle for accommodating the mobile toy, the receptacle including an opening for passing the mobile toy and a floor plate having a slot formed therethrough for partly projecting the driven wheel outwards. Provided to the receptacle are a holding device for releasably holding the mobile toy so that the driven wheel engages the slot for stopping the rotation thereof by friction and another device for pushing the mobile toy toward the opening so that the driven wheel is disengaged from the slot when the holding is released.

4 Claims, 2 Drawing Figures

LAUNCHING APPARATUS FOR RESILIENT DRIVE MOBILE TOY

BACKGROUND OF THE INVENTION

The present invention relates to a launching apparatus for resilient drive mobile toys such as windup toy motorcycle, windup toy motorcar and the like.

Conventionally, for launching such toy vehicle there has been a launching apparatus using an inclined plate and the like the toy vehicle slides down. This launching apparatus merely imparts an initial acceleration to the toy by the inclined plate, and gives little pleasure of launching operation and no interest in launching mechanism to the player.

SUMMARY OF THE INVENTION

Accordingly, it is an object of the present invention to provide a launching apparatus for resilient drive mobile toys which apparatus appears to launch them as if by itself without the aid of any other force, and hence gives large interest in the apparatus with a great pleasure to the children.

It is another object of the present invention to provide a launching apparatus for resilient drive mobile toys which provides to children a large interest in launching mechanism and great pleasures in operation.

With these and other objects in view the present invention provids a launching apparatus for a resilient drive mobile toy having a driven wheel, comprising: a receptacle for accommodating the mobile toy, the receptacle including an opening for passing the mobile toy and a floor having a slot formed therethrough for partly projecting the driven wheel outwards; means, provided to said receptacle, for releasably holding the mobile toy so that the driven wheel engages the slot for stopping the rotation thereof by friction; and means, provided to the receptacle, for pushing the mobile toy toward the opening so that the driven wheel is disengaged from the slot when the holding is released.

DETAILED DESCRIPTION OF THE PREFERRED EMBODIMENTS

Figure 1:
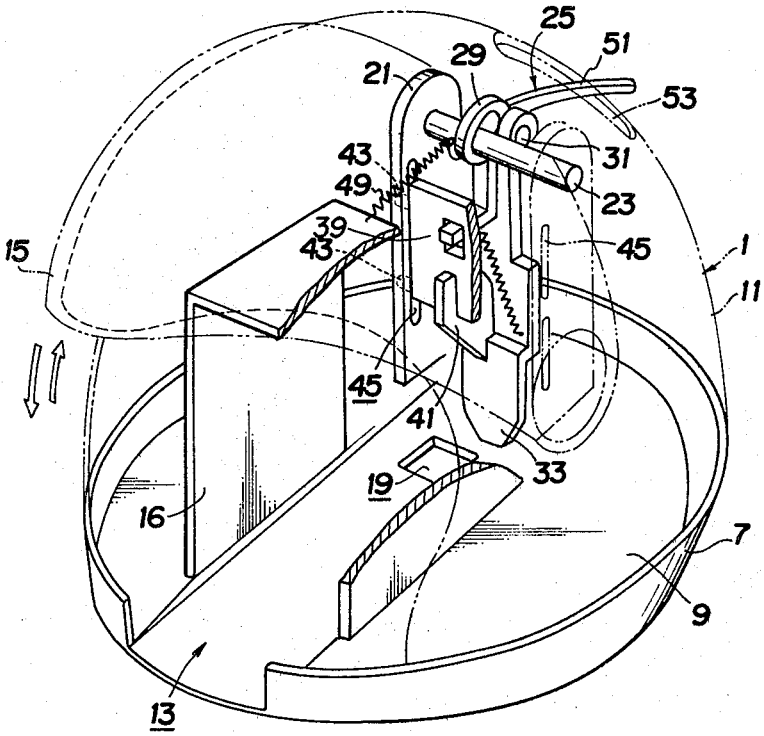
FIG. 1 is a perspective view partly cut away of one embodiment of the invention.
Figure 2:
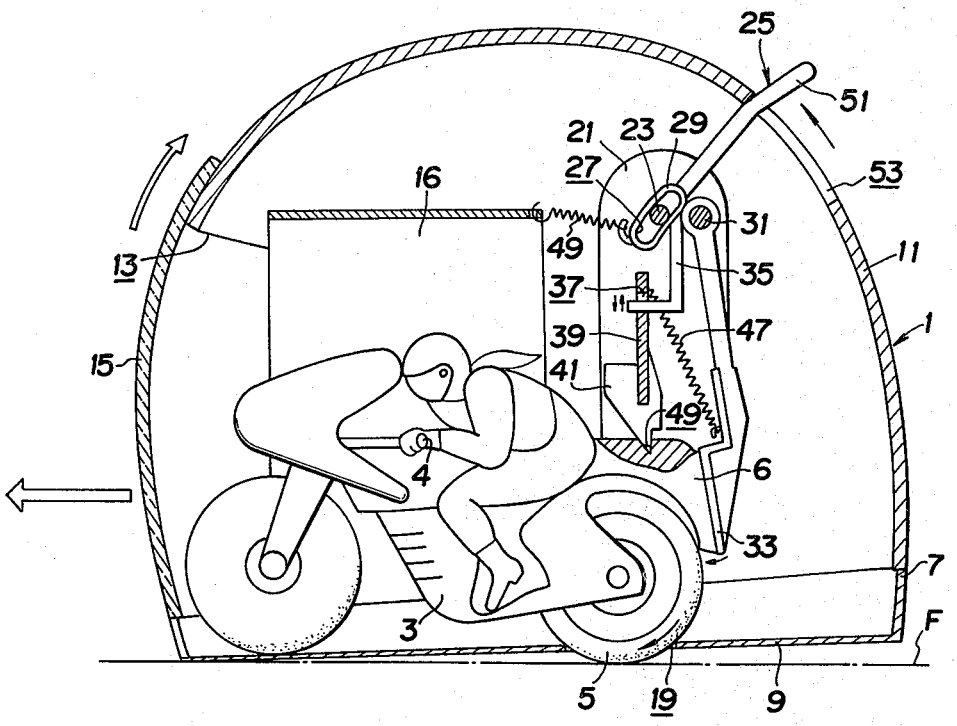
FIG. 2 is a vertical section of the launching apparatus in FIG. 1 in which a toy motorcycle is set.

Referring to FIGS. 1 and 2, a reference numeral 1 designates a receptacle for accommodating a windup toy motorbicycle 3 of which a rear wheel 5 is driven in a conventional manner by a restoring force of a spiral spring (not shown) incorporated in the toy motorcycle 3. The receptacle 1 includes a base 7 having a circular floor plate 9, and a cap 11 of substantially semi-spherical shape with its edge jointed to the base 7. Furthermore, the receptacle 1 is provided at its front portion with an opening 13 and a visor 15 hinged to the cap 11 so as to close and open the opening 13, and thus is generally of a shape of helmet. On the floor plate 9 of the receptacle 1, there is substantially centrally erected a holding frame 16 of a channel member for keeping the toy motorcycle 3 from falling sidewards as shown in FIG. 2. The holding frame 16 is disposed to form towards the opening 13 a starting way 17 along which the toy motorcycle 3 is launched. The floor plate 9 is provided adjacent to the rearside of the holding frame 16 with a slot 19 for partly projecting the rear wheel 5 of the toy motorbicycle 3 outwards, and adjacent to the slot 19 with a pair of parallel supporting plates 21 and 21 vertically erected. Between the upper portions of the supporting plates 21 and 21 there extends a beam 23 which rotatably supports a substantially bell-crank-shaped main lever 25 by passing through a curved slot 27 formed in a supported portion 29 of that lever 25. On the supported portion 29 there is mounted through a pin 31 a push lever 33 for pushing the toy motorcycle 3 toward the opening 13 of the receptacle 1 so that it is vertically rotatable. One arm 35 of the main lever 25 is of a L shape, the distal end of which loosely passes through a slot 37 formed through a sliding plate 39 which is integrally formed with a stopper 41. The slide plate 39, which is partly shown in FIG. 1, is of a rectangular shape, and is provided at its each side edge with two pins 43 and 43 which slidably fit in a vertical slot 45 formed in a corresponding supporting plate 21. The slide plate 39 is connected through a coil spring 47 to the push lever 33, which is thereby urged toward that slide plate. Also, the supported portion 29 of the main lever 25 is connected through another coil spring 49 to the holding frame 16, and thereby the main lever 25 is urged to be held in a position shown in FIG. 2. The other arm 51 of the main lever 25 passes through a slot 53 formed vertically through the top portion of the cap 11.

In operation, the visor 15 is moved upwards to a raised position shown in FIG. 1 by the phantom line, and then the top motorcycle 3 is brought into the receptacle 1. The backward movement of the toy motorcycle 3 rotates the push lever 33 backwards against the spring 47 and raises the stopper 41 upwards by its rear end portion 6. When the stopper 41 falls into and engages a groove 49 formed in the rear end portion 6 of the motorcycle 3, part of the rear wheel 5 falls into the slot 19 formed through the floor plate 9 and projects outwards thereof as shown in FIG. 2. The toy motorcycle 3 is kept from falling sidewards by bringing either one of projecting ends of a handle 4 into contact with the inner face of the holding frame 16. After the toy motorcycle 3 is placed in a set position shown in FIG. 2, the visor 15 is rotated downwards so as to close the opening 13 of the receptacle 1, which is then moves backward on a floor F with slight depression by hand while the rear wheel 5 which projects outwards of the slot 19 is placed in contact with that floor F. In this event, the rear wheel 5 is slightly moved upwards relative to the receptacle 1 by pressing down the latter, so that the rear wheel 5 comes out of contact with the slot 19. Thus, this backward movement of the rceptacle 1 causes the rear wheel 5 to rotate by friction with the floor F in a reverse direction indicated by the arrow in FIG. 2, which winds up the spiral spring through a gear transmission (not shown) incorporated in the toy motorcycle 3. When the receptacle 1 is released from the depression by hand, the rear wheel 5 is brought back into engagement with slot 19 by stopper 41 urged downwards by spring 47, and is stopped its rotation by the friction force which is exerted by the periphery of the slot 19, so that the restoring force of the wound spiral spring of the toy motorcycle 3 is stored. To launch the toy motorcycle 3 out of the receptacle 1, the other arm 51 of the main lever 25 is pressed down from an upper position in FIG. 2 to a lower position in FIG. 1 after the visor 15 is moved upward to the raised position, so that the stopper 41 is raised and disengaged from the groove 49 of the toy motorcycle 3, resulting in that the rear wheel 5 is brought out of engagement with the slot 19 by the push lever 33 which is urged towards the toy motorcycle 3 by the spring 47. Now, the rear wheel 5 of the toy motorcycle 3 is freely rotated by the restoring force of the spiral spring incorporated therein, and thus it dashes out of the launching receptacle 1 through the opening 13.

What is claimed is:

1. A launching apparatus for a resilient drive mobile toy having a drive wheel, comprising:

a receptacle for accommodating the mobile toy, said receptacle including an opening for passing the mobile toy and a floor plate having a slot formed therethrough for partly projecting said driven wheel outwards;

means, provided to said receptacle, for releasable holding the mobile toy so that said driven wheel engages said slot for stopping the rotation thereof by friction; and means comprising a first lever pivotally supported by said receptacle and spring biased for pushing the mobile toy toward said opening so that said driven wheel is disengaged from said slot when said holding is released.

2. A launching apparatus as recited in claim 1, wherein said holding means comprises a supporting frame mounted on said floor plate, a second lever having two arms and supported by said frame so as to be rotatable in a vertical plane, and a stopper vertically slidably supported by said frame and spring biased to urge said driven wheel downwards for stopping when the latter is placed in engagement with said slot, said stopper being connected to one arm of said second lever for vertical movement by the rotation of the latter.

3. A launching apparatus as recited in claim 2, wherein said receptacle includes a cap having the form of a helmet and a visor hinged to said cap for closing the opening.

4. A launching apparatus as recited in claim 3, wherein the mobile toy is a toy motorcycle, and wherein said holding means further includes a holding frame mounted on said floor plate for keeping said toy motorcycle from falling sidewards.

* * * * *